US008584555B2

(12) United States Patent
Chan

(10) Patent No.: US 8,584,555 B2
(45) Date of Patent: Nov. 19, 2013

(54) OPEN-END RATCHET WRENCH

(76) Inventor: Shu-Su Chan, Changhua (TW)

( * ) Notice: Subject to any disclaimer, the term of this patent is extended or adjusted under 35 U.S.C. 154(b) by 221 days.

(21) Appl. No.: 13/207,424

(22) Filed: Aug. 11, 2011

(65) Prior Publication Data

US 2013/0036874 A1 Feb. 14, 2013

(51) Int. Cl.
*B25B 13/46* (2006.01)

(52) U.S. Cl.
USPC ..... 81/58.2; 81/60; 81/57.39

(58) Field of Classification Search
USPC ..... 81/58.2, 60, 62, 63.1, 63.2, 57.13, 81/57.29, 57.39
See application file for complete search history.

(56) References Cited

U.S. PATENT DOCUMENTS 735,134 A * 8/1903 McLean ..... 81/57.29
5,924,341 A * 7/1999 Brooks ..... 81/58.2
6,490,953 B2 * 12/2002 Horvath ..... 81/57.39
7,080,578 B2 * 7/2006 Izumisawa ..... 81/57.39
7,793,568 B2 * 9/2010 Mitcheltree et al. ..... 81/57.39
2006/0137493 A1 * 6/2006 Nagata ..... 81/62
2006/0248986 A1 * 11/2006 Horvath ..... 81/57.39
2011/0162486 A1 * 7/2011 Lee et al. ..... 81/58.2

* cited by examiner

*Primary Examiner* — David B Thomas
(74) *Attorney, Agent, or Firm* — Raymond Y. Chan; David and Raymond Patent Firm

(57) ABSTRACT

An open-end ratchet wrench includes a gripping handle, an actuating arm, a head base, a ratchet wheel, two ratchet pawls, and a damping member. The head base has an actuating hole, the actuating arm has an offset latch, and the actuating hole has an enough margin. The ratchet wheel includes an outer tooth portion, a holding hole, and an opening shaped and sized to match with the gap. Each of the two ratchet pawls comprises a coupling tooth portion for coupling with the outer tooth portion of the ratchet wheel, an escaping area for escaping from the outer tooth portion of the ratchet wheel, and a resilient member to retain a firmly engagement between the coupling tooth portion and the outer tooth portion, so that the actuating arm drives the ratchet wheel to apply a single direction rotating force.

9 Claims, 8 Drawing Sheets

OPEN-END RATCHET WRENCH

BACKGROUND OF THE PRESENT INVENTION

1. Field of Invention

The present invention relates to an open-end ratchet wrench, and more particularly to an open-end ratchet wrench adapted for reducing tooth gaps between a ratchet wheel and a ratchet pawl thereof, and prolonging a lifespan of the wrench.

2. Description of Related Arts

A conventional ratchet wrench is not suitable for operation on a cool air pipe nor an oil-pressure pipe, so that an open-end wrench has to be used instead. Therefore, a conventional open-end ratchet wrench has been developed in view of this inconvenience. But the current open-end ratchet wrench has several disadvantages as follows.

Firstly, when a coupling tooth portion of a ratchet pawl is coupled with an outer tooth portion of a ratchet wheel, tooth gaps are inevitably formed between the coupling tooth portion and the outer tooth portion. Thus, unwanted noise and vibration are produced during operation, and positioning errors and unsatisfied performance are also easy taken place.

Secondly, an opening of the ratchet wheel is not provided at a position along a center line of the wrench handle, so that two ratchet pawls cannot be symmetrically provided at two sides of the center line. Therefore, when a user applies a single direction force to drive the wrench handle, stress is easy to be concentrated on the ratchet pawls and the coupling tooth portion of the ratchet pawls may prone to break up, so that the life span of the wrench is not relatively long.

Thirdly, this kind of open-end ratchet wrench is neither motor driven nor air driven. Accordingly, a user has to manually operate on the wrench handle, so that this kind of wrench is hard to meet a requirement of effective and efficient operation performance.

SUMMARY OF THE PRESENT INVENTION

The invention is advantageous in that it provides an open-end ratchet wrench adapted for reducing tooth gaps between a ratchet wheel and a ratchet pawl thereof, and prolonging a lifespan of the wrench.

Additional advantages and features of the invention will become apparent from the description which follows, and may be realized by means of the instrumentalities and combinations particular point out in the appended claims.

According to the present invention, the foregoing and other objects and advantages are attained by an open-end ratchet wrench comprising:

a gripping handle, wherein the gripping handle has an axis hole, a top panel and a bottom panel provided at a front end of the axis hole, a free space defined between the top panel and the bottom panel, a receiving hole penetrating the top panel and the bottom panel, and a slot channel communicating with the receiving hole;

an actuating arm pivotally provided in the axis hole, wherein the actuating arm comprises an offset latch;

a head base provided in the free space, wherein the head base has an actuating hole, a hole opening communicating the actuating hole to outside, a mounting adapter being not capable of escaping from the hole opening, a compartment hole provided at a position corresponding to the receiving hole, a gap shaped and sized to match with the slot channel, a first holding chamber indentedly provided in a wall along the compartment hole, and a second holding chamber indentedly provided on the wall along the compartment hole, wherein the mounting adapter is coupled with the offset latch and the actuating hole has an enough margin for the mounting adapter to slide upwardly and downwardly;

a ratchet wheel pivotally provided in the receiving hole and also received in the compartment hole, wherein the ratchet wheel comprises an outer tooth portion on the outer circumference thereof, wherein the ratchet wheel further has a holding hole longitudinally penetrating a center thereof and an opening communicating the holding hole to outside, wherein the opening is shaped and sized to match with the gap;

a damping member mounted on the gripping handle for providing a damping effect to the ratchet wheel during operation of the ratchet wheel; and two ratchet pawls provided in the first holding chamber and the second holding chamber respectively, wherein each of the two ratchet pawls comprises a coupling tooth portion on a right portion of a first side thereof for coupling with the outer tooth portion of the ratchet wheel, and an escaping area on a left portion of the first side thereof for escaping from the outer tooth portion of the ratchet wheel, wherein each of the two ratchet pawls further comprises a resilient member on a second side opposite to the first side thereof for providing a predetermined resilient force, so as to retain a firmly engagement between the coupling tooth portion and the outer tooth portion, wherein the actuating arm drives the ratchet wheel to apply a single direction rotating force.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
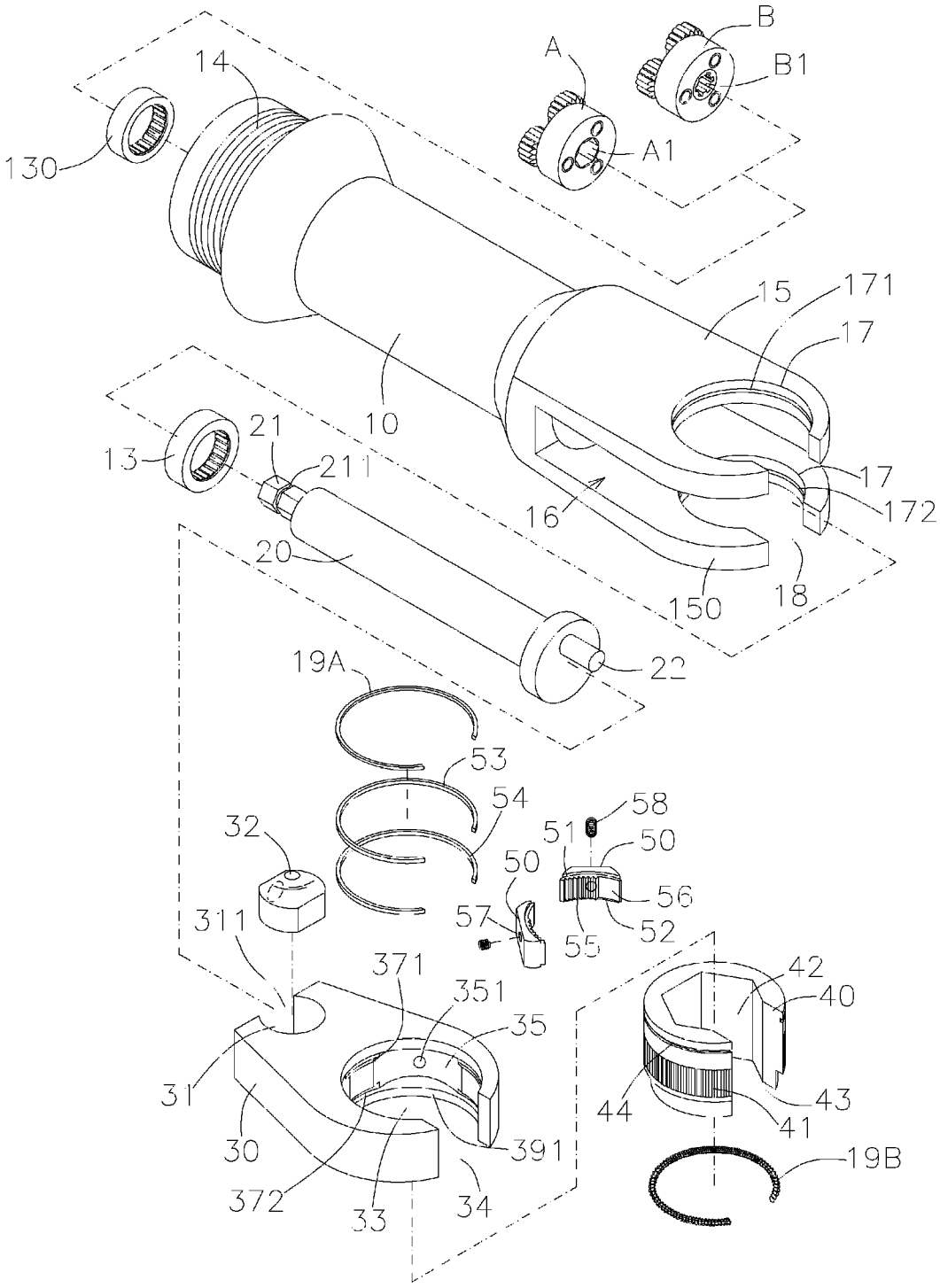
FIG. 1 is an exploded view of an open-end ratchet wrench according to a preferred embodiment of the present invention.
Figure 2:
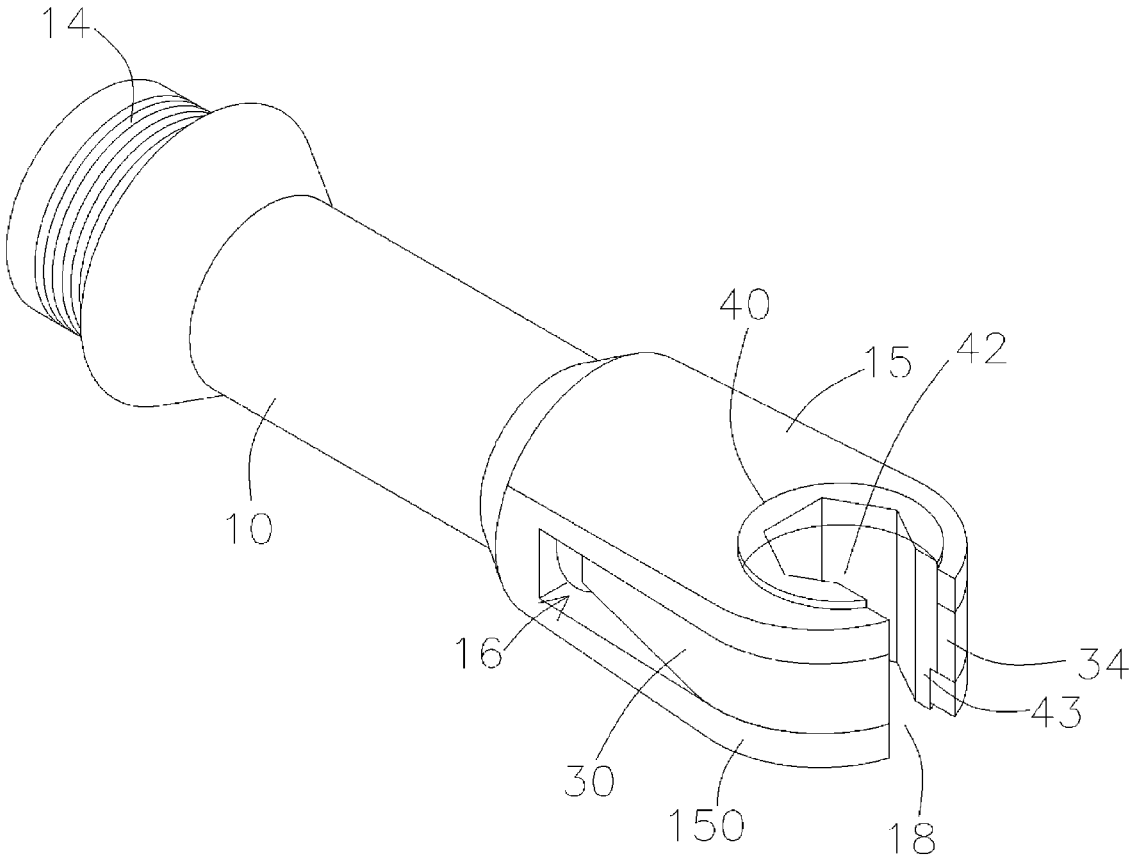
FIG. 2 is a perspective view of the open-end ratchet wrench according to the above preferred embodiment of the present invention.

Referring to FIG. 1 to FIG. 5A of the drawings, an open-end ratchet wrench according to a preferred embodiment of the present invention is illustrated, wherein the open-end ratchet wrench comprises a gripping handle 10, an actuating arm 20, a head base 30, a ratchet wheel 40 and two ratchet pawls 50.

The gripping handle 10 has a front end, a rear end, and an axis hole 11 extended between the front end and the rear end along a central axis thereof. Accordingly, a front bearing hole 12 having a first relatively larger diameter is coaxially provided at the front end while a rear bearing hole 120 having a second relatively larger diameter is coaxially provided at the rear end, wherein two bearings 13, 130 are mounted in the front bearing hole 12 and the rear bearing hole respectively. The griping handle 10 comprises a locking sleeve 14 coaxially protruded from the rear end of the gripping handle 10, wherein the locking sleeve 14 has an outer thread portion for coupling with an outer casing of a handheld motor or an air actuator (not shown in the drawings).

The gripping handle 10 further comprises a top panel 15 protrudedly extended from the front end above the axis hole 11, a bottom panel 150 protrudedly extended from the front end below the axis hole 11 facing towards the top panel 15 wherein the gripping handle has a free space 16 defined between the top panel 15 and the bottom panel 150, a receiving hole 17 penetrating the top panel 15 and the bottom panel 150, and a slot channel 18 communicating the receiving hole 17 to outside where the receiving hole 17 is constructed in C-shape. It is worth mentioning that the slot channel 18 is symmetrically arranged at two sides of the central axis of the axis hole 11. Furthermore, the top panel 15 has a first hook slot 171 indentedly provided in a wall along the receiving hole 17, and the bottom panel 150 has a sealing slot 172 indentedly provided in a wall along the receiving hole 17, wherein a hook ring 19A is mounted in the first hook slot 171 while a damping member 19B is mounted in the sealing slot 172. Accordingly, two ends of the first hook slot 171 and two ends of the sealing slot 172 are not communicated with the slot channel 18, so that the hook ring 19A is retained in the first hook slot 171 while the damping member 19B is retained in the sealing slot 172 in such a manner that the inner holes defined by the hook ring 19A and the damping member 19B are symmetrically extended to the receiving hole 17. It is worth mentioning that the damping member 19B can be embodied as a circular spring.

The actuating arm 20 which is provided in the axis hole 11 is supported by the two bearings 13, 130. The actuating arm 20 comprises a hex union 21 coaxially and protrudedly extended from a rear end thereof, wherein the hex union 21 is received in the locking sleeve 14 in such a manner that when the outer casing of a handheld motor is coupled with the locking sleeve 14, a drive module A in the handheld motor is capable of being mounted to the actuating arm 20 by means of engagement between a hex latch hole A1 thereof and the hex union 21, so that the actuating arm 20 is capable of rotating with respect to the central axis. Similarly, when the outer casing of a handheld air actuator is coupled with the locking sleeve 14, a drive module B of the handheld air actuator is capable of being mounted to the actuating arm 20 by means of engagement between corner pores B1 thereof and the hex union 21, so that the actuating arm 20 is capable of rotating with respect to the central axis. In other words, the hex union 12 is suitable both for the handheld motor or the air actuator. In order to prevent the hex union from detaching from the handheld motor or the air actuator, the actuating arm 20 may further have a fastening slot 211 encircledly provided along the outer circumference thereof, so that steel balls (not shown) in the hex latch hole A1 or the corner pores are received in the fastening slot 211 to retain the hex union 12 in position. In addition, the actuating arm 20 comprises an offset latch 22 protrudedly extended from a front end thereof, wherein the offset latch 22 extends into the free space 16 at a rear side of the receiving hole 17.

The head base 30 is mounted in the free space 16 and sandwiched and retained by the top panel 15 and the bottom panel 150. Accordingly, the head base 30 has an actuating hole 31 longitudinally provided at a center of a rear edge thereof, and a hole opening 311 longitudinally provided at the rear edge thereof for communicating the actuating hole 31 to outside. The hole opening 311 is adapted for the offset latch 22 to be inserted therein. The head base 30 further comprises a mounting adapter 32 mounted in the actuating hole 31, wherein an outer circumference of the mounting adapter 32 is adapted to rotates in the actuating hole 31 while not being capable of sliding out of the hole opening 311. The mounting adapter 32 has a pivot hole indentedly provided therein for coupling with the offset latch 22, wherein when the offset latch 22 rotates to guide the mounting adapter 32 to move upwardly or downwardly, the actuating hole 31 and the hole opening 311 provide an enough margin for the mounting adapter 32 and the offset latch 22 to slide upwardly and downwardly. The head base 30 further has a compartment hole 33 shaped and sized to match with the receiving hole 17, a gap 34 shaped and sized to match with the slot channel 18 so that the compartment hole 33 is constructed in C-shape, a first holding chamber 35, and a second holding chamber 36 indentedly provided at a position having a same height with the compartment hole 33, wherein the first holding chamber 35 and the second holding chamber 36 are symmetrically provided at two sides of the central axis of the axis hole 11. The first holding chamber 35 and the second holding chamber 36 have first ring slots 371, 372 indentedly formed on a top edge and a bottom edge thereof respectively, wherein two ends of each of the two first ring slots 371, 372 are not communicated with the gap 34.

The ratchet wheel 40 is pivotally provided in the receiving hole 17 and also received in the compartment hole 33, wherein the ratchet wheel 40 comprises an outer tooth portion 41 on the outer circumference thereof. The ratchet wheel 40 further has a holding hole 42 longitudinally penetrating a center thereof for coupling with a screw or a bolt W, and an opening 43 communicating the holding hole 42 to outside, wherein the opening 43 is shaped and sized to match with the gap 34, so that the ratchet wheel 40 is constructed in C-shape. The ratchet wheel 40 further has a second hook slot 44 encircledly provided along an outer circumference thereof for the hook ring 19A to be mounted therein. Accordingly, the damping member 10B is biasing against the outer circumference along a bottom edge of the ratchet wheel 40. It is worth mentioning that two ends of the second hook slot 44 are communicated with the opening 43, so that when the ratchet wheel 40 rotates along the hook ring 19A in the receiving hole 17, the damping member 19B is capable of providing a damping effect.

Figure 3:
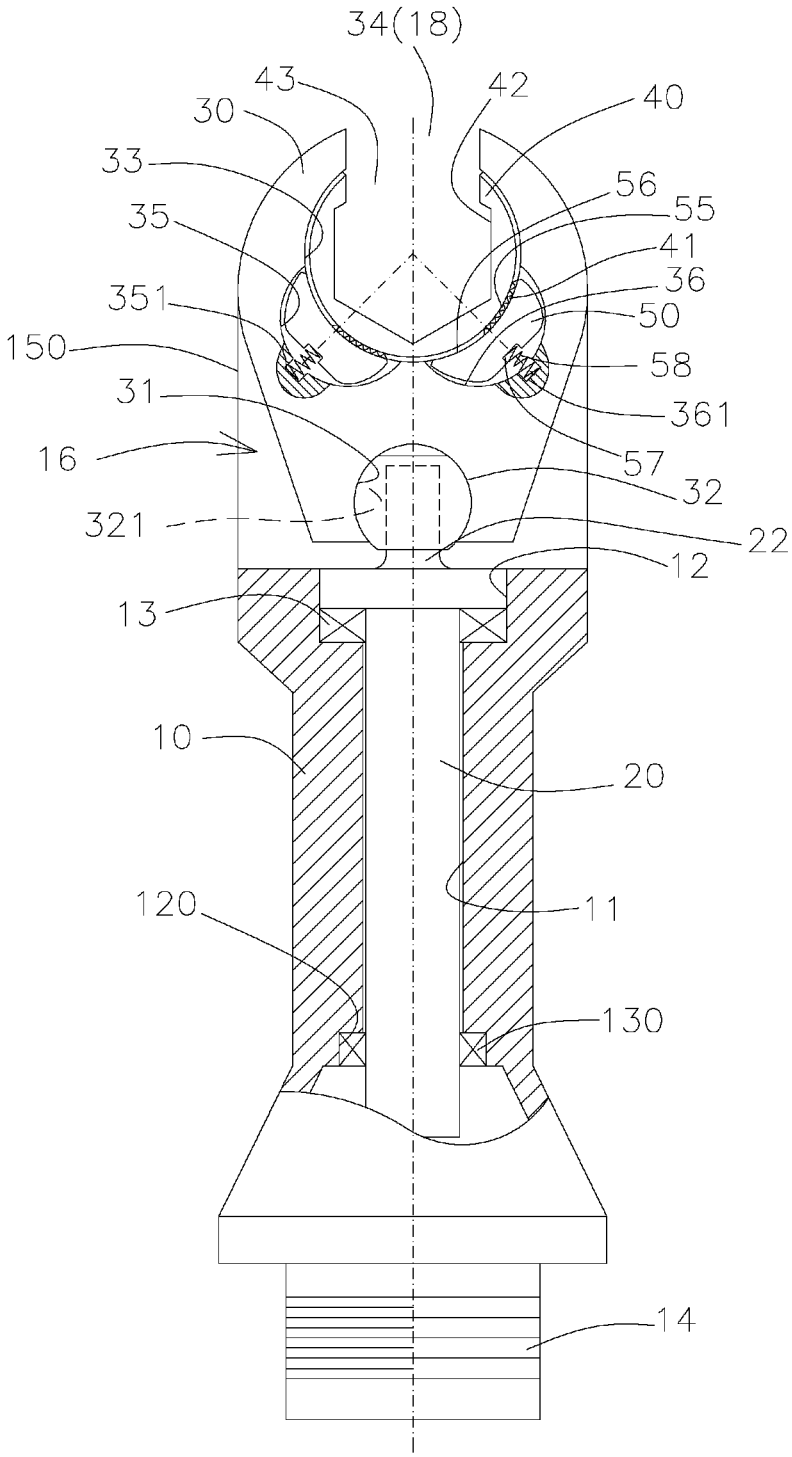
FIG. 3 is a sectional view of the open-end ratchet wrench according to the above preferred embodiment of the present invention.
Figure 4:
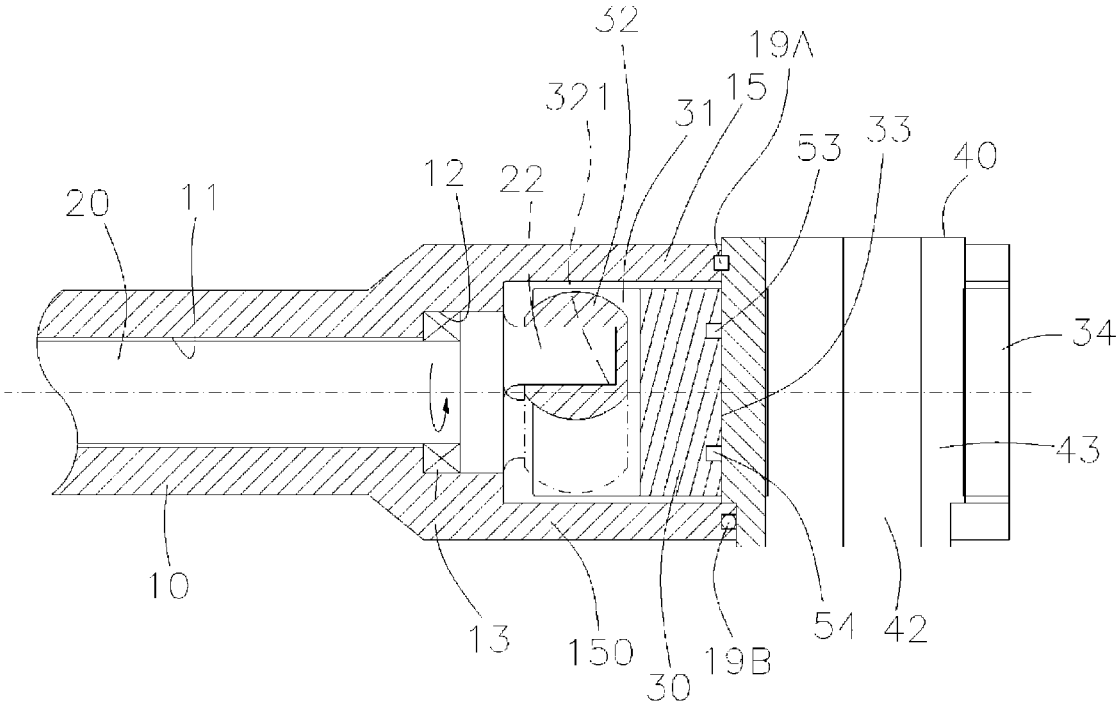
FIG. 4 is a schematic view illustrating a mounting adapter slides upwardly and downwardly in an actuating hole.

The two ratchet pawls 50 are provided in the first holding chamber 35 and the second holding chamber 36 respectively, as shown in FIG. 1, FIG. 3 and FIG. 4. Accordingly, the two ratchet pawls 50 has two second ring slots 51, 52 to couple with the first ring slots 371, 372 respectively, wherein two retaining rings 53, 54 are mounted at a position corresponding to the first ring slots 371, 372 and the second ring slots 51, 52 respectively, so that the two ratchet pawls 50 are retained in the first holding chamber 35 and the second holding chamber 36 respectively. It is noteworthy that the retaining rings 53, 54 do not interfere with the rotation of the outer tooth portion 41 of the ratchet wheel 40. Accordingly, a vacant space is defined between the two ratchet pawls 50 and the corresponding first and second holding chamber 35, 36.

Each of the two ratchet pawls 50 comprises a coupling tooth portion 55 on a right portion of a first side surface thereof for coupling with the outer tooth portion 41 of the ratchet wheel 40, and an escaping area 56 on a left portion of the first side thereof for escaping from the outer tooth portion 41 of the ratchet wheel 40. Each of the two ratchet pawls 50 further has an assembling indent 57 in a second side surface opposite to the first side surface thereof. Accordingly, each of the two ratchet pawls 50 further comprises a resilient member 58, a first end of the resilient member 58 is mounted in the assembling indent 57 while a second end of the resilient member 58 is biasing against the indent 351, 361 of the holding chamber 35, 36. Each of the resilient member 58 provides a predetermined resilient force so as to retain a firmly engagement between the coupling tooth portion 55 of the ratchet pawl 50 and the outer tooth portion 41 of the ratchet wheel 40.

During operation of the open-end ratchet wrench of the present invention, a screw W is directly and coaxially inserted into the holding hole 42 or is longitudinally put into the holding hole 42 through the opening 43 first, and then a user actuate a self-rotation of the driving arm 20 through a hand-held motor or an air actuator, so that the offset latch 22 drives the mounting adapter 32 to rotate in such a manner that the longitudinal movement of the offset latch 22 is capable of driving the mounting adapter 32 to move upwardly or downwardly in the actuating hole 31. Accordingly, a transverse movement is also attained by the pivotal engagement between the mounting adapter 32 and the actuating hole 31, so that the head base 30 is capable of swinging leftward or rightward about the receiving hole 17 and the screw W.

Figure 5A:
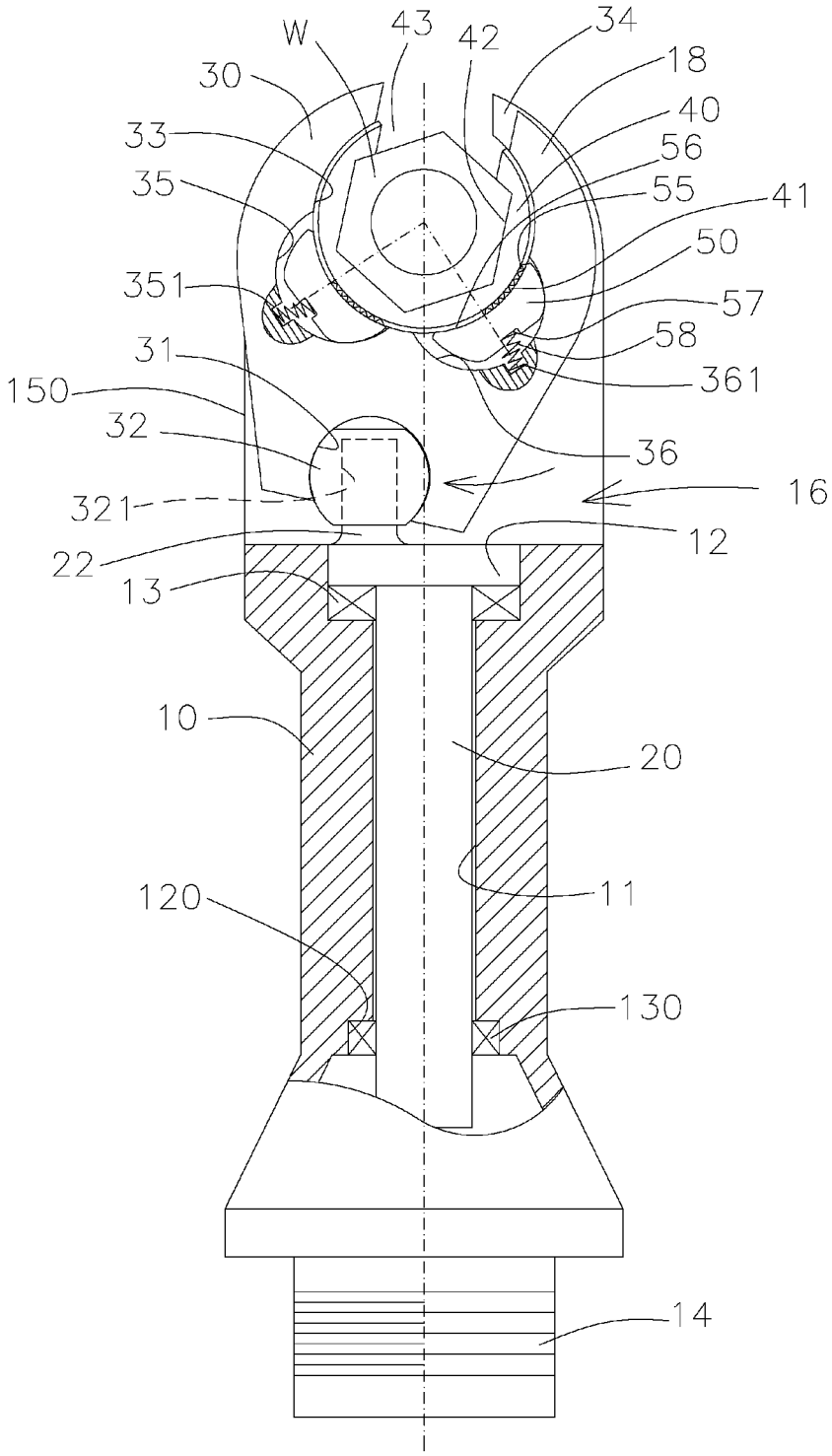
FIG. 5A is a schematic view illustrating the open-end ratchet wrench rotating clockwise to operate on a screw.
Figure 5B:
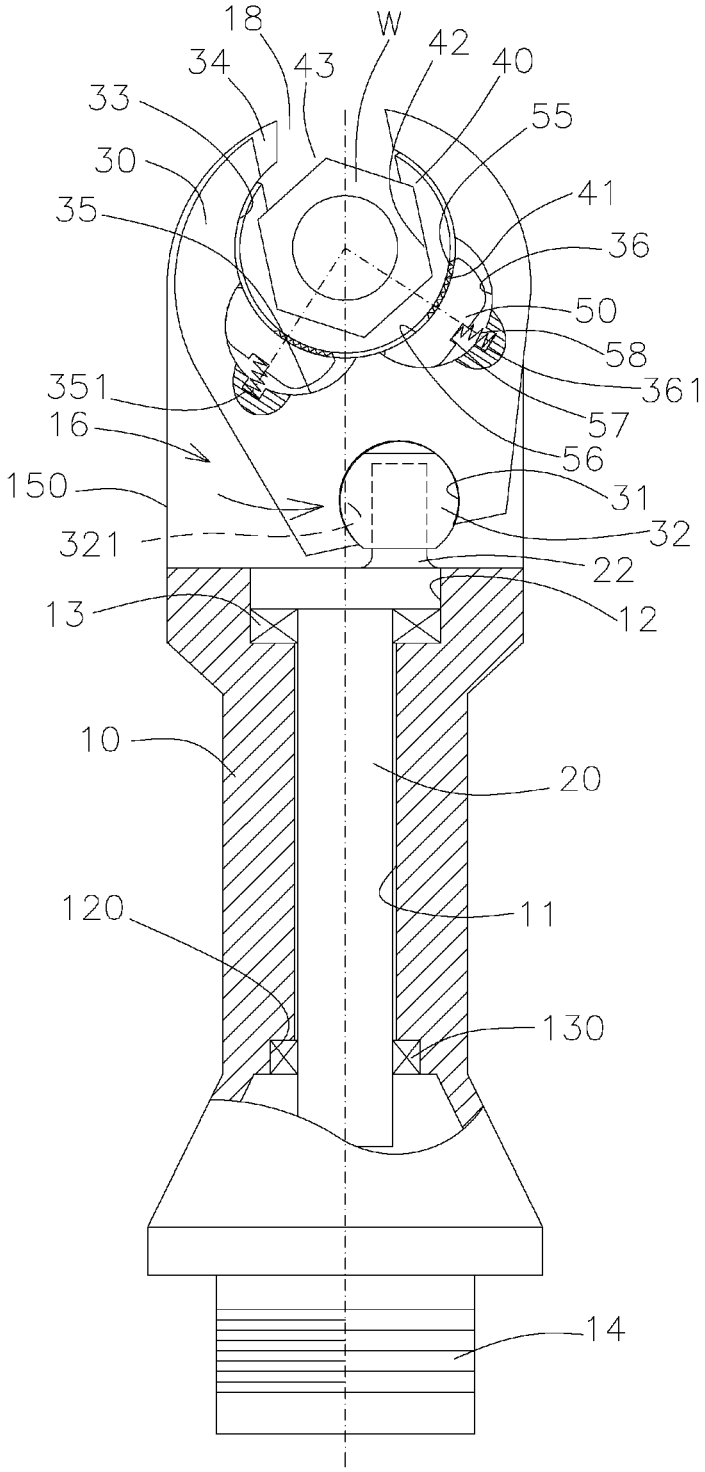
FIG. 5B is a schematic view illustrating the open-end ratchet wrench rotating counterclockwise to a position ready for a next operation.

Referring to FIG. 5A of the drawing, when the offset latch 22 guides the mounting adapter 32 to swing leftward, a side surface of each of the first and second holding chamber 35, 36 biases against the right side of the ratchet pawl 50, so that when the coupling tooth portion 55 engages with the outer tooth portion 41, a clockwise rotating force can be applied to rotate the ratchet wheel 40 and the screw W. Referring to FIG. 5B of the drawing, when the offset latch 22 guides the mounting adapter 32 to swing rightward, the right side of the ratchet pawl 50 escapes from the corresponding side surface of the first and second holding chamber 35, 36, so that the coupling tooth portion 55 jumps away from the outer tooth portion 41. In other words, when the ratchet pawl 50 detaches from the outer tooth portion 41 through the escaping area 42 of the ratchet wheel 40, the open-end ratchet wrench rotates counterclockwise to a position ready for a next operation.

Figure 6A:
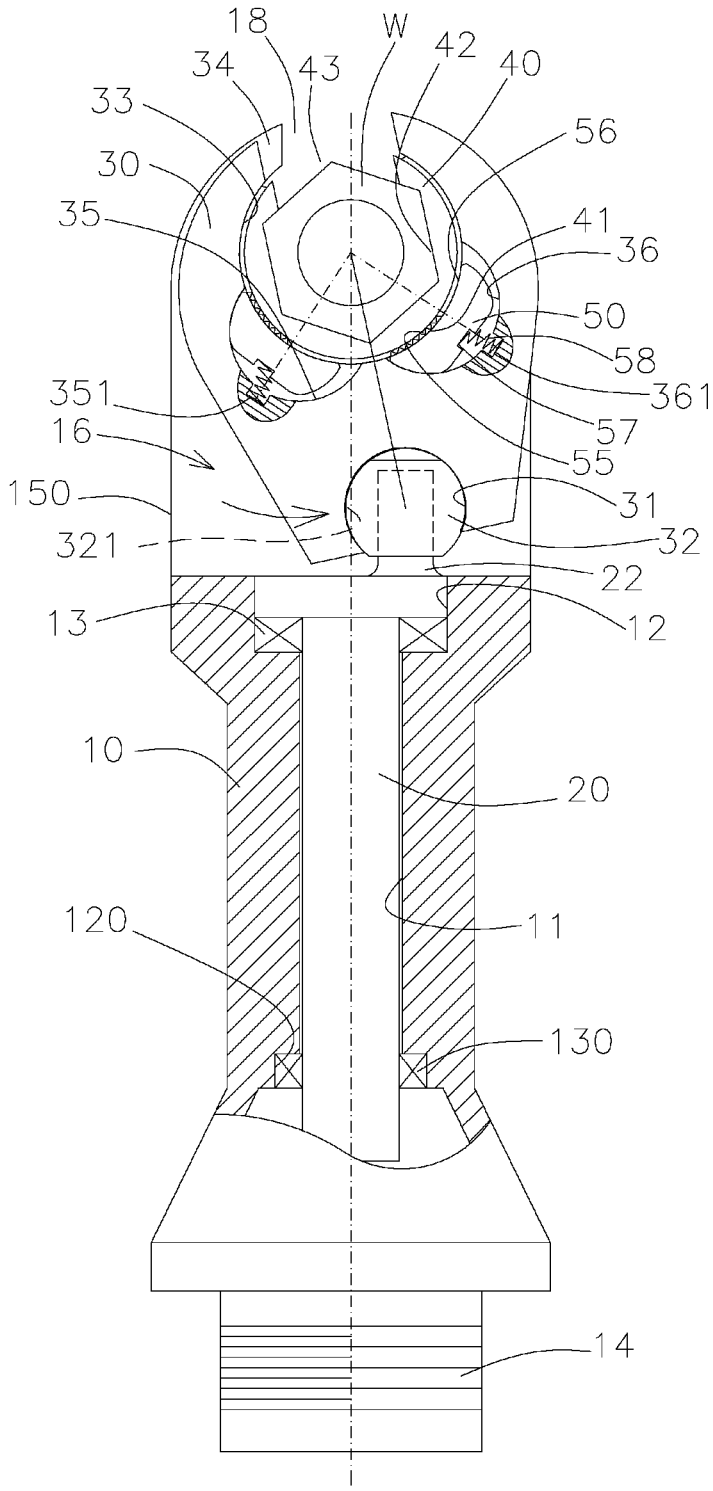
FIG. 6A is a schematic view illustrating the open-end ratchet wrench rotating counterclockwise to operate on a screw.
Figure 6B:
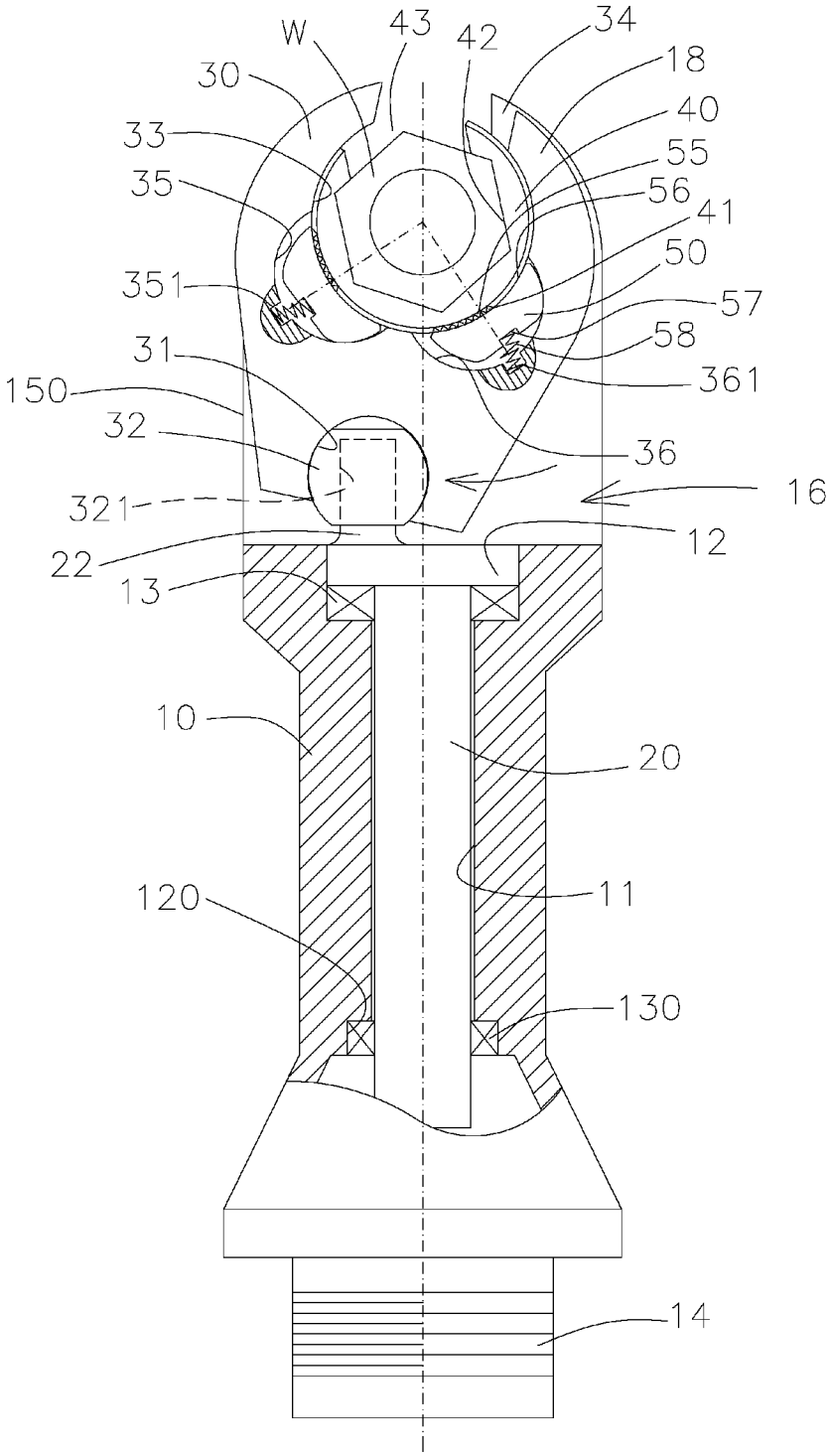
FIG. 6B is a schematic view illustrating the open-end ratchet wrench rotating clockwise to a position ready for a next operation.

Referring to FIG. 6A and FIG. 6B, when the gripping handle 10 of the above open-end ratchet wrench is arranged upside-down, a counterclockwise rotating force can be applied to rotate the ratchet wheel 40 and the screw W, and a clockwise rotating force can be applied to bring the open-end ratchet wrench to a position ready for a next operation.

The present invention is advantageous in that when the ratchet wheel 40 rotates in the receiving hole, the damping member 19B is capable of eliminating the tooth gaps between the outer tooth portion 41 of the ratchet wheel 40 and the coupling tooth portion 55 of the ratchet pawl 50, so that a firmly and precisely engagement between the ratchet wheel 40 and the ratchet pawl 50 is attained, and thus the performance of the driving mechanism is enhanced.

Another advantage of the present invention is that when the open-end ratchet wrench of the present invention is employed to fasten or loosen the screw W, a motor or an air actuator is introduced to facilitate the operation of the wrench, so that the operation is both time-saving and effort-saving.

Another advantage of the present invention is that the gap 34 of the head base 30 and the opening 43 of the ratchet wheel 40 are provided at a position along a center line of the driving arm 20, and two ratchet pawls 50 are symmetrically provided at two sides of the center line 20. Therefore, when the ratchet wheel 40 is driven to rotate with a single direction force, stress concentration on the ratchet pawls 40 is minimized, so that the coupling tooth portion 55 of the ratchet pawls 50 is not easy to break up, so that the life span of the wrench is prolonged.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An open-end ratchet wrench, comprising:

a gripping handle having an axis hole, a top panel and a bottom panel provided at a front end of said axis hole, a free space defined between said top panel and said bottom panel, a receiving hole penetrating said top panel and said bottom panel, and a slot channel communicating with said receiving hole;

an actuating arm, which is pivotally provided in said axis hole, comprising an offset latch;

a head base, which is provided in said free space, having an actuating hole, a hole opening communicating said actuating hole to outside, a mounting adapter being not capable of escaping from said hole opening, a compartment hole provided at a position corresponding to said receiving hole, a gap shaped and sized to match with said slot channel, a first holding chamber indentedly provided in a wall along said compartment hole, and a second holding chamber indentedly provided on said wall along said compartment hole, wherein said mounting adapter is coupled with said offset latch and said actuating hole has an enough margin for said mounting adapter to slide upwardly and downwardly;

a ratchet wheel pivotally provided in said receiving hole and received in said compartment hole, wherein said ratchet wheel comprises an outer tooth portion on said outer circumference thereof, wherein said ratchet wheel further has a holding hole longitudinally penetrating a center thereof, and an opening communicating said holding hole to outside, wherein said opening is shaped and sized to match with said gap;

a damping member mounted on said gripping handle for providing a damping effect to said ratchet wheel during operation of said ratchet wheel; and two ratchet pawls provided in said first holding chamber and said second holding chamber respectively, wherein each of said two ratchet pawls has a coupling tooth portion on a right portion of a first side thereof for coupling with said outer tooth portion of said ratchet wheel, and an escaping area on a left portion of said first side thereof for escaping from said outer tooth portion of said ratchet wheel, wherein each of said two ratchet pawls further comprises a resilient member on a second side opposite to said first side thereof for providing a predetermined resilient force, so as to retain a firmly engagement between said coupling tooth portion and said outer tooth portion, wherein said actuating arm drives said ratchet wheel to apply a single direction rotating force.

2. The open-end ratchet wrench, as recited in claim 1, further having a sealing slot indentedly provided in a wall along said receiving hole, wherein a damping member is mounted in said sealing slot, wherein two ends of said sealing slot are not communicated with said slot channel, wherein said damping member is retained in said sealing slot in such a manner that an inner hole defined by said damping member is symmetrically extended to said receiving hole, wherein an outer surface of said ratchet wheel biases against said damping member within said inner hole defined by said damping member.

3. The open-end ratchet wrench, as recited in claim 1, wherein said first holding chamber and said second holding chamber are symmetrically provided at two sides of a central axis of said axis hole.

4. The open-end ratchet wrench, as recited in claim 3, wherein said first holding chamber and said second holding chamber, each having a same height, have two first ring slots indentedly formed on a top edge and a bottom edge thereof in said compartment hole respectively, wherein two ends of each of said two first ring slots are not communicated with said gap, wherein said two ratchet pawls has two corresponding second ring slots to couple with said first ring slots respectively, wherein two retaining rings are mounted at a position corresponding to said first ring slots and said second ring slots respectively, wherein said two ratchet pawls are retained in said first holding chamber and said second holding chamber respectively, whereby said retaining rings do not interfere with a rotation of said outer tooth portion of said ratchet wheel.

5. The open-end ratchet wrench, as recited in claim 1, wherein said top panel has a first hook slot indentedly provided in a wall along said receiving hole and said bottom panel has a sealing slot indentedly provided in a wall along said receiving hole, wherein a damping member is mounted in said sealing slot, wherein two ends of said sealing slot are not communicated with said slot channel, wherein said damping member is retained in said sealing slot in such a manner that an inner hole defined by said damping member is symmetrically extended to said receiving hole, wherein an outer surface of said ratchet wheel biases against said damping member within said inner hole defined by said damping member, wherein said ratchet wheel further has a second hook slot encircledly provided along an outer circumference thereof, wherein a hook ring is mounted in said second hook slot and two ends of said second hook slot are communicated with said opening.

6. The open-end ratchet wrench, as recited in claim 1, wherein said griping handle comprises a locking sleeve coaxially protruded from a rear end of said gripping handle, wherein said actuating arm comprises a hex union which is coaxially and protrudedly extended from a rear end thereof and received in said locking sleeve.

7. The open-end ratchet wrench, as recited in claim 1, wherein said gripping handle further has a front bearing hole having a first relatively larger diameter coaxially provided at a front end thereof, and a rear bearing hole having a second relatively larger diameter coaxially provided at a rear end thereof, wherein two bearings are mounted in said front bearing hole and said rear bearing hole respectively while said actuating arm is supported by said two bearings.

8. The open-end ratchet wrench, as recited in claim 1, wherein said head base is retained and sandwiched between said top panel and said bottom panel and said actuating hole is longitudinally provided at a center of a rear edge thereof.

9. The open-end ratchet wrench, as recited in claim 1, wherein each of said two ratchet pawls has an assembling indent in a second side surface thereof, wherein each of said two ratchet pawls further comprises a resilient member having a first end thereof mounted in said assembling indent and a second end thereof biasing against an indent of said first holding chamber or said second holding chamber.

* * * * *